US006299658B1

(12) United States Patent
Moriguchi et al.

(10) Patent No.: US 6,299,658 B1
(45) Date of Patent: Oct. 9, 2001

(54) CEMENTED CARBIDE, MANUFACTURING METHOD THEREOF AND CEMENTED CARBIDE TOOL

(75) Inventors: Hideki Moriguchi; Akihiko Ikegaya, both of Itami (JP)

(73) Assignee: Sumitomo Electric Industries, Ltd., Osaka (JP)

( * ) Notice: Subject to any disclaimer, the term of this patent is extended or adjusted under 35 U.S.C. 154(b) by 0 days.

(21) Appl. No.: 09/117,155

(22) PCT Filed: Dec. 11, 1997

(86) PCT No.: PCT/JP97/04564

§ 371 Date: Jul. 23, 1998

§ 102(e) Date: Jul. 23, 1998

(87) PCT Pub. No.: WO98/27241

PCT Pub. Date: Jun. 25, 1998

(30) Foreign Application Priority Data

Dec. 16, 1996 (JP) ..... 8-334342

(51) Int. Cl.[7] ..... B24D 3/04; C22C 29/02; C22C 29/04; C22C 29/08; C22C 1/05

(52) U.S. Cl. ..... 51/307; 51/293; 407/119; 419/11; 419/13; 419/14; 419/15; 419/18; 75/237; 75/240; 75/241; 75/242; 75/243; 501/87; 428/548; 428/551; 428/552; 428/698; 428/697; 428/701; 428/702

(58) Field of Search ..... 51/293, 307; 407/119; 428/220, 336, 698, 697, 704, 701, 702, 699, 548, 551, 552; 75/237, 240, 241, 242, 243; 419/18, 11, 13, 14, 15; 501/87

(56) References Cited

U.S. PATENT DOCUMENTS

Re. 34,180 * 2/1993 Nemeth et al. ..... 428/547
4,150,984 4/1979 Tanaka et al. .

(List continued on next page.)

FOREIGN PATENT DOCUMENTS 02047239 2/1990 (JP) .
02138434 5/1990 (JP) .
02274827 11/1990 (JP) .
03138331 6/1991 (JP) .
04289146 10/1992 (JP) .
05000850 1/1993 (JP) .
05339659 12/1993 (JP) .
07278719 10/1995 (JP) .
08199285 8/1996 (JP) .
08253836 10/1996 (JP) .

OTHER PUBLICATIONS

Japanese Industrial Standard (JIS), Tungsten powder and tungsten carbide powder, JIS H 2116–1995 (no month).
Japanese Industrial Standard (JIS), Indexable Inserts for Cutting Tools–Designation, JIS B 4120–1985.
Powder Metallurgy Principles and Applications by F.V. Lenel; Metal Powder Industries Federation, Princeton, New Jersey, USA, III, pp. 384 to 391 (no date).

* cited by examiner

*Primary Examiner*—Michael Marcheschi
(74) *Attorney, Agent, or Firm*—W. F. Fasse; W. G. Fasse

(57) ABSTRACT

In a cemented carbide, at least one compound 3 including a carbide, a nitride or carbo-nitride of at least one component selected from IVa, Va and VIa group elements or a solid solution thereof exists in at least some WC crystal grains 1. Preferably the compound 3 is in the form of compound grains 3 comprising a carbide, a nitride or a carbo-nitride of Ti, Zr, Hf or W or a solid solution thereof, having an average grain diameter smaller than 0.3 $\mu$m. The compound grains make up at most 10% of the cross-sectional area of the WC crystal grains that contain the compound grains, while at least 10% of the total cross-sectional area of the cemented carbide is made up of such WC crystal grains that contain the compound grains.

18 Claims, 1 Drawing Sheet

U.S. PATENT DOCUMENTS

| | | | | |
|---|---|---|---|---|
| 4,212,671 | | 7/1980 | Ettmayer et al. . | |
| 4,279,651 | | 7/1981 | Fujimori et al. . | |
| 4,574,011 | | 3/1986 | Bonjour et al. . | |
| 4,684,405 | | 8/1987 | Kolaska et al. . | |
| 4,698,266 | * | 10/1987 | Buljan et al. | 428/698 |
| 4,911,989 | * | 3/1990 | Minoru et al. | 428/547 |
| 4,923,511 | | 5/1990 | Krizan et al. . | |
| 4,923,512 | | 5/1990 | Timm et al. . | |
| 4,950,328 | | 8/1990 | Odani et al. . | |
| 4,985,070 | | 1/1991 | Kitamura et al. . | |
| 5,030,519 | | 7/1991 | Scruggs et al. . | |
| 5,106,674 | * | 4/1992 | Okada et al. | 407/119 |
| 5,145,506 | | 9/1992 | Goldstein et al. . | |
| 5,181,953 | * | 1/1993 | Nakano et al. | 75/237 |
| 5,223,020 | | 6/1993 | Kolaska . | |
| 5,248,328 | | 9/1993 | He et al. . | |
| 5,273,571 | | 12/1993 | Mirchandani et al. . | |
| 5,281,260 | | 1/1994 | Kumar et al. . | |
| 5,306,326 | | 4/1994 | Oskarsson et al. . | |
| 5,308,376 | | 5/1994 | Oskarsson . | |
| 5,314,657 | | 5/1994 | Ostlund . | |
| 5,368,628 | | 11/1994 | Friederichs . | |
| 5,370,719 | | 12/1994 | Teruuchi et al. . | |
| 5,370,944 | * | 12/1994 | Omori et al. | 428/548 |
| 5,421,852 | | 6/1995 | Maruyama et al. . | |
| 5,503,925 | * | 4/1996 | Nakano et al. | 428/212 |
| 5,624,766 | * | 4/1997 | Moriguchi et al. | 428/548 |
| 5,643,658 | * | 7/1997 | Uchino et al. | 428/698 |
| 5,976,707 | * | 11/1999 | Grab | 428/548 |

CEMENTED CARBIDE, MANUFACTURING METHOD THEREOF AND CEMENTED CARBIDE TOOL

TECHNICAL FIELD

The present invention relates to a tungsten carbide (hereinafter referred to as "WC") based cemented carbide having well balanced hardness and toughness, used for cutting tools, shock resistant tools such as a bit, and for plastic working tools such as rolls and can making tools.

BACKGROUND ART

Conventionally, cemented carbide comprised of crystal grains mainly formed of WC and binder phase mainly formed of iron group metal such as Co or Ni has been used for various cutting tools and wear resistant tools as it has superior hardness, toughness and modulus of rigidity. However, along with widened application of cemented carbide recently., there has been greater need for WC based cemented carbide having higher hardness and toughness.

In order to satisfy such demand, Japanese Patent Laying-Open Nos. 2-47239, 2-138434, 2-274827 and 5-339659 propose cemented carbide in which the WC crystal grains have a plate-like shape in order to realize hardness and toughness higher than the conventional cemented carbide.

Japanese Patent Laying-Open No. 5-339659 mentioned above discloses a cemented carbide in which more than 15% of WC crystal grains in the cemented carbide are plate-like WC crystal grains having maximum dimension of 110~10 $\mu$m, which is twice or more of the minimum dimension. Japanese Patent Laying-Open No. 7-278719 or 8-199285 discloses an alloy containing plate-like WC crystal grains having the ratio of the maximum dimension with respect to the minimum dimension of 3~20 (hereinafter, this ratio will be referred to as aspect ratio: when a cemented carbide containing crystal grains mainly consisting of WC and a binder phase mainly consisting of an iron group metal contains plate-like WC crystal grains and an arbitrarily selected cross section of the cemented carbide is observed by a scanning electron microscope, the ratio of the maximum dimension with respect to the minimum dimension of an individual plate-like WC crystal grain at the arbitrary cross section).

In the proposals above, characteristics of the alloy can be improved to some extent. However, manufacturing cost has been increased, as special raw material powder or special method of manufacturing is employed. Further, the amount of generated plate-like WC crystal grains is unstable, resulting in unstable alloy characteristics.

Though toughness is improved to some extent by the generation of the plate-like WC crystal grains, strength of some plate-like WC crystal grains which coarsened too much is not necessarily higher as compared with WC crystal grains which are not coarsened, causing much variation in strength of the cemented carbide itself. Further, when WC crystal grains are coarsened, the alloy comes to have lower hardness. Therefore, development of WC based cemented carbide having more superior hardness and toughness has been desired.

SUMMARY OF THE INVENTION

The present invention was made to solve the above-described problems. An object of the present invention is to provide a cemented carbide and a cemented carbide tool having stable strength and superior hardness and toughness.

The cemented carbide in accordance with the present invention is comprised of crystal grains mainly consisting of WC and a binder phase mainly consisting of an iron group metal. Herein, the phrase "mainly consisting of . . . " means that the largest part or portion of the stated composition consists of the stated component, according to standard dictionary definitions. In at least part of the WC crystal grains, a compound exists which is a compound of a carbide, a nitride or a carbo-nitride, of at least one component selected from the group consisting of the group IVa, Va and VIa elements or a solid solution thereof, other than WC which is the essential main component of the hard phase (in the following, "said compound" refers to the compound defined here).

The inventors made various efforts to attain the above-described object and succeeded in manufacturing a cemented carbide having stable strength and superior hardness and toughness. More specifically, the inventors of the present invention have found that by the existence of said compound in at least part of the plate-like WC crystal grains, a strain is generated in the WC crystal grains, which strain assists reinforcement of the WC crystal grains.

Japanese Patent Laying-Open No. 5-850 discloses composite hard ceramic grains in which compressive stress is generated in the WC crystal grains by dispersing a Ti compound in WC crystal grains. The powder fabricated in accordance with this method, however, does not fully exhibit its effect in liquid phase sintering as in the present invention, though it is suitable as a raw material for solid phase sintering. This may be the case that the raw material is dissolved and re-precipitated during liquid phase sintering, reducing to half the effects. The present invention allows fabrication of WC crystal grains having the above-described structure at a low cost in liquid phase sintering, without the necessity of advanced preparing a special raw material such as used in Japanese Patent Laying-Open No. 5-850. Further, according to Japanese Patent Laying-Open No. 5-850, it is necessary to disperse Ti compound of 10% to 70% by volume in order to reinforce WC crystal grains. By contrast, in the present invention, reinforcement of WC crystal grains is possible with the amount of compound dispersed to at most 10% in area ratio. The area ratio of WC crystal grains having said compound existing in the crystal grains should preferably be at least 10% and, more preferably, more than 30% of the area of all WC crystal grains.

It is particularly preferable that said compound is a carbide, a nitride or a carbo-nitride of Ti, Zr, Hf or W, or solid solution thereof. Among these, a carbide, a nitride or carbo-nitride of Zr has much effect in improving toughness and strength. The reason for this is that the compound of carbide, nitride or carbo-nitride of Ti, Zr, Hf or W or solid solution thereof is easily taken into WC crystal grains, exhibiting the effects of the present invention. The content of Ti, Zr and Hf with respect to the cemented carbide as a whole should preferably be 10 wt % at most. More preferably, the content should be at most 5 wt %. This is because too large an amount of Ti, Zr or Hf will cause a degraded sintering characteristic and a reduced strength of the cemented carbide.

It is not necessary that said compound exists only in the WC crystal grains. The compound may exist both in the WC crystal grains and the binder phase. When the grain diameter (in case of a polygon, represented by the maximum length of a diagonal, and in case of a triangle, represented by the maximum length of a side: the same applies to grain diameter of WC crystal grains) of said compound is smaller than lam, reinforcement of WC crystal grains is facilitated, remarkably improving toughness. Grain diameter of said compound not larger than 0.3 μm is particularly preferable.

When percentage by weight of the carbide, nitride or carbo-nitride of at least one component selected from Va and VIa group elements or a solid solution thereof in the cemented carbide is represented by Wa and percentage by weight of a carbide, a nitride or carbo-nitride of at least one component selected from IVa group elements or a solid solution thereof is represented by Wb, especially superior balance between toughness and hardness is exhibited if the value Wa/Wb is 0~0.2.

The reason is as follows. The compound of the carbide, nitride or carbo-nitride of a group IVa element such as Ti, Zr or Hf or a solid solution thereof is easily taken into WC crystal grains, while the compound of the carbide, nitride or carbo-nitride of at least one component selected from Va and VIa group elements or a solid solution thereof is hardly taken into WC crystal grains, and has a function of suppressing grain growth of WC crystal during sintering. Therefore, when the value of Wa/Wb is set to 0~0.2, the effects of the present invention are easily exhibited. This is the reason of numerical limitation.

From the reason described above, when the content of the carbide, nitride or carbo-nitride of at least one component selected from Va and VIa group elements or a solid solution thereof is at most 10 wt % with respect to the weight of the binder phase, the incorporation of the compound of the carbide, nitride or carbo-nitride of at least one component selected from Va and VIa group elements or a solid solution thereof into WC crystal grains is facilitated.

In a cross sectional microstructure of the cemented carbide, when the area ratio of WC crystal grains having the grain diameter of at most 1 μm is 10~40% of the area of all WC crystal grains and the are a ratio of WC crystal grains having grain diameter larger than 1 μm is 60~90%, a cemented carbide having especially superior hardness and toughness is obtained if the said compound exists mainly in WC crystal grains having the grain diameter exceeding 1 μm.

The area ratio of WC crystal grains having the grain diameter of at most lam is limited to 10~40% of the area of all WC crystal grains, since when it is smaller than 10%, the hardness is decreased, and when it exceeds 40%, toughness is decreased. The area ratio of WC crystal grains having the grain diameter exceeding 1 μm is defined to be 60–90%, since when it is smaller than 60%, toughness is decreased and when it exceeds 90%, hardness is decreased.

When said compound exists in WC crystal grains having a shape with an aspect ratio of 2 or more on the cross sectional microstructure, especially superior hardness and toughness are exhibited. The reason for this may be that lowering hardness generally resulting from grain growth of WC crystal grains is suppressed by the existence of said compound in the WC crystal grains, and that the effect of improved toughness owing to WC crystal grain growth and reinforcement of WC crystal grains itself are remarkable.

Of the aforementioned WC crystal grains having the grain diameter of 1 μm or more, when those of which shape has the aspect ratio of at least 2 in cross sectional microstructure is contained by 30% or more, toughness is especially improved. Generally, hardness lowers when the aspect ratio is increased to be 2 or more. However, when said compound exists in the grains, lowering of the hardness is suppressed. Accordingly, a cemented carbide having superior toughness and hardness can be manufactured. The effect of existence of said compound in WC crystal grains is still expected even when the aspect ratio is 1~2.

The desirable method of manufacturing a cemented carbide in accordance with the present invention includes the following steps. However the method of manufacturing a cemented carbide in accordance with the present invention is not limited to the following method. WC powder having average grain diameter of 0.6~1 μm (raw material A), WC powder having average grain diameter of at least twice the raw material A (raw material B), powder of at least one metal selected from Co, Ni, Cr, Fe and Mo (raw material C), and a carbide, a nitride or carbo-nitride of at least one component selected from IVa, Va and VIa group elements or solid solution thereof having average grain diameter of 0.01~0.5 μm (raw material D) are used as raw material powders, respectively, and sintered at a temperature of, preferably, at least 1500° C. In this manner, the cemented carbide in accordance with the present invention can be manufactured stably. Average grain diameters of raw materials A, B and D may be attained to the aforementioned values during the step of milling or mixing.

In the above described method, it is not necessary to use a special raw material powder such as described in Japanese Patent Laying-Open Nos. 2-47239, 2-138434 and 2-274827. Further, it is unnecessary to mill WC powder to 0.5 μm or smaller as described in Japanese Patent Laying-Open No. 5-339659. Accordingly, commercially available WC powder having grain diameter close to the WC raw material grain diameter may be utilized without excessive milling. Accordingly, entrance of contaminant from a milling-mixing apparatus (e.g. attritor) or oxidation of WC powder at the time of excessive milling can be suppressed. As a result, a cemented carbide having superior characteristic can be manufactured stably at low cost.

The phenomenon of this solution and re-precipitation of WC to the liquid phase as a mechanism of growth of plate-like WC crystal grains (the phenomenon in which fine WC is dissolved into liquid phase and re-precipitated on coarse WC) is considered to be the main cause enabling stable manufacture of the cemented carbide containing plate-like WC crystal grains. Further, use of two types of WC powders of which average grain diameters (also referred to as Fisher-Sub-Sieve Sizer grain diameter, representing average grain diameter measured by an apparatus in accordance with JIS H2116: same in the following) of the raw material WC powder after milling and mixing differ twice or more, and preferably three times or more from each other, is considered also contributing. Since two types of WC powders having different average diameters are used as raw materials, driving force for dissolution and re-precipitation of WC is improved, facilitating generation of plate-like WC crystal grains. In addition, coarse WC added as raw material B exists uniformly in the raw material powder, functioning as seed crystals of grain growth. Accordingly, local growth of plate-like WC is suppressed, so that plate-like WC crystal grains are generated stably in the sintered body regardless of difference in powder lot or sintering lot.

When uniform milling fails by some cause in the step of milling, WC grain size distribution is widened as a result, promoting generation of plate-like WC crystal grains, it has been reported that extremely coarse WC crystal grains referred to as α2 are generated even in the conventional manufacturing method. However, since grain size of coarse WC is not controlled, stable generation of plate-like WC crystal grains has been impossible. By contrast, in accordance with the method of the present invention, by controlling ratio of mixing of raw materials A and B and difference in average grain sizes between raw materials A and B, it becomes possible to control organization including shape, grain size and distribution of WC crystal grains. According to the method of the present invention, when coarse WC having few defects and having superior characteristics is used as raw material B, the WC grows by the dissolution and re-precipitation phenomenon, with WC being the seed crystal. Therefore, similar to the Bridgman —method well known in the field of semiconductor manufacturing, it is possible to generate plate-like WC having small defects and superior characteristic. Further, by the use of two types of WC powders having different grain sizes described above, incorporation of raw material D into WC grains is facilitated.

Commercially available WC raw material may be used as WC powder of raw material A or B. Powder of which grain size is adjusted by preliminary milling (raw material A has average grain diameter of 0.6~μm, raw material B has average grain diameter of twice or more) may be soft mixed in a ball mill, for example, to be used. Alternatively, two or more types of commercially available WC powders having different average grain diameters and attaining target grain sizes in the step of mixing or milling may be used.

When raw material D having average grain diameter of 0.01~0.5 μm or raw material D of which average grain diameter attains to 0.01~0.5 μm in the step of milling or mixing is used as the raw material powder, incorporation of raw material D into crystal grains at the time of dissolution and re-precipitation of WC is facilitated. Accordingly, the cemented carbide in accordance with the present invention can be fabricated stably. In order to prepare raw material having such small average grain diameter, raw material powder fabricated by liquid phase synthesis such as sol-gel method or gas phase synthesis such as PVD or CVD, other than the general milling method, may be used. Here, average grain diameter of raw material D is set to be 0.01~0.5 μm, as it is industrially difficult to reduce the grain diameter to be smaller than 0.01 μm, and incorporation of raw material D into WC crystal grains is hindered when the grain diameter exceeds 0.5 μm.

When the ratio WA/WB of weight WA of raw material A and weight WB of raw material B is 0.5~30, cemented carbide of particularly high performance can be obtained. More preferably, the ratio WA/WB is 1~10. When the value WA/WB is smaller than 0.5, it becomes difficult to generate plate-like WC crystal grains of which the aspect ratio is greater than 2. When the value WA/WB is larger than 30, generation of plate-like WC crystal grains becomes unstable, and coarse plate-like WC crystal grains tend to be generated locally. Further, it becomes difficult for said compound to be incorporated into the WC crystal grains.

It is possible to use WC powder obtained by recycling used cemented carbide by a recycling method (such as zinc processing method or high temperature processing method) for at least part of raw material A. This enables manufacturing of the cemented carbide in accordance with the present invention at a low cost, and wasteful mining of tungsten (W) can be suppressed, which is preferable in view of global environmental protection. Though attempts have been made to use recycled powder of cemented carbides, use of recycled powder at present is not widespread but extremely limited.

Recycling is generally performed in accordance with the zinc processing method. Grain size of the recycled WC powder depends on the WC crystal grain size of the used cemented carbide to be recycled. Therefore, it is impossible to fabricate WC raw material of a specific grain size. In the high temperature processing method, WC crystal grains are subjected to grain growth locally during processing. Therefore, the grain size distribution of WC powder is extremely wide even if the powder is milled thereafter. For this reason, fabrication of a cemented carbide using the recycled powder suffers from the problem that performance is unstable, as it is impossible to control distribution of WC crystal grain size.

By contrast, in the method of manufacturing of the present invention, recycled powder having the grain diameter in the range of 0.6—1 μm reproduced from used cemented carbide as the raw material of recycling is dissolved in liquid phase in the process of sintering, and re-precipitated on raw material B having larger average grain diameter. This enables control of the grain diameter of plate-shaped WC crystal in the fabricated sintered body by the grain size of WC powder of raw material B. Accordingly, the grain size of the recycled powder does not determine the grain diameter of the final sintered body, thus avoiding the above described problem. Further, in the present method, fine raw material A is dissolved in liquid phase and thereafter re-precipitated on coarse grain raw material B, as described above, so that characteristics of the plate-shaped WC depends on the characteristics of coarse grain raw material B. Therefore, even when recycled raw material having unstable characteristics is used, a sintered body having superior characteristics can be fabricated.

When the ratio WR/WA of weight WR of the WC powder, which is recycled by milling the used cemented carbide as the raw material for recycling with respect to weight WA of raw material A is 0.3~1 (preferably, 0.5~1), the cemented carbide of the present invention can be fabricated especially at a low cost, and a cemented carbide preferable in view of global environmental protection is obtained.

When a coating including at least one layer of a carbide, a nitride, an oxide, or a boride of at least one component selected from IVa, Va, VIa group elements or Al, or a solid solution thereof, or selected from diamond, DLC and CBN is provided on a surface of a tool formed of the above described cemented carbide and the coated tool is used as a cutting tool or a wear resistant tool, particularly high performance is exhibited as the substrate material has very well balanced hardness and toughness.

Especially when a coating of at least 20 μm is provided on the conventional WC based cemented carbide, it is considered that the coating promotes generation of cracks (function of Griffith's pre-crack). This results in lower chipping resistance of the cemented carbide. In the cemented carbide of the present invention, however, said compound is precipitated in WC crystal grains, reinforcing the WC crystal grains, so that cracks do not develop, ensuring superior chipping resistance.

Figure 1:
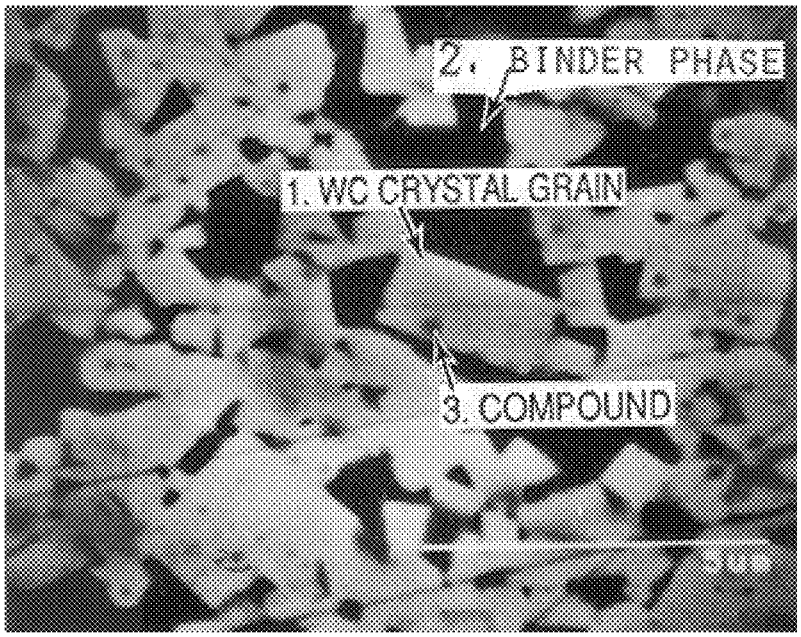
FIG. 1 is a scanning electron microscope photograph of the cemented carbide according to an example of the invention.

DETAILED DESCRIPTION OF THE INVENTION AND BEST MODE FOR CARRYING OUT THE INVENTION

Best mode of the present invention will be described in the following with reference to FIGS. 1 and 2 as well as Tables 1 to 14.

(Embodiment 1)

WC powder (raw material A) having average grain diameter of 0.7 μm prepared by milling by an attritor with high milling efficiency, and WC powder (raw material B) having average grain diameter of 2 μm prepared by similar milling were prepared as raw material powders. Co powder having average grain diameter of 1.5 μm, Ni powder having average grain diameter of 1.3 μm, ZrC powder having average grain diameter of 0.3 μm, TiC powder having average grain diameter of 0.5 μm, HfC powder having average grain diameter of 0.5 μm, NbC powder having average grain diameter of 0.3 μm, TaC powder having average grain diameter of 0.4 μm, $Cr_3C_2$ powder having average grain diameter of 0.3 μm, ZrN powder having average grain diameter of 0.5 μm, solid solution powder of (W, Ti)(C, N) having average grain diameter of 0.5 μm, solid solution powder of (W, Zr)C having average grain diameter of 0.5 μm and solid solution powder of (Ta, Nb)C having average grain diameter of 0.5 μm were added and mixed to have the compositions listed in Table 1, and mixed for 2 hours in an acetone solvent, using a common ball mill. Thereafter, granulation was performed by a spray dryer.

of 2 μm, NbC powder having average grain diameter of 2 μm, TaC powder having average grain diameter of 1.5 μm, $Cr_3C_2$ powder having average grain diameter of 2 μm, ZrN powder having average grain diameter of 1.5 μm, solid solution powder of (W, Ti)(C, N) having average grain diameter of 2 μm, solid solution powder of (W, Zr)C having average grain diameter of 1.5 μm and solid solution powder of (Ta, Nb)C having average grain diameter of 1.8 μm in accordance with the prior art were mixed for 7 hours in an attritor and granulated in the similar manner to fabricate powder. The powder was pressed using a mold with a pressure of 1 ton/cm$^2$, and held for 1 hour at 1400° C. in vacuum, for sintering. Hardness and fracture toughness of the sintered body were measured in the similar manner.

Further, it was measured as to whether a compound of a carbide, a nitride or carbo-nitride of at least one component selected from IVa, Va and VIa group elements or a solid solution thereof exists in the WC crystal grains. More specifically, samples for scanning electron microscope or transmission electron microscope were fabricated, and element analysis was performed by an EDX (Energy Dispersive X-ray Spectrometer, which refers to energy dispersive fluorescent X-ray analysis for performing electrical spectral selection using a semiconductor detector). When Ti and C were detected, the substance was considered as TiC. The results of measurement are as shown in Table 2. In sample numbers of Table 2, numbers 1-1 to 10 represent sintered bodies fabricated in accordance with the method of the present invention, while numbers 2-1 to 10 represent sintered bodies fabricated according to a conventional method.

TABLE 1

| Raw Material No. | Raw Material A | Raw Material B | Co | Ni | ZrC | TiC | HfC | TaC | Others | Wa/Wb |
|---|---|---|---|---|---|---|---|---|---|---|
| 1 | 72 | 20 | 6 | 0 | 0 | 2 | 0 | 0 | 0 | 0 |
| 2 | 60 | 30 | 7 | 0 | 2 | 0 | 0 | 0 | 1% ZrN | 0 |
| 3 | 77.8 | 10 | 10 | 0 | 0 | 1 | 1 | 0 | 0.2% $Cr_3C_2$ | 0.1 |
| 4 | 66.7 | 15 | 15 | 0 | 1 | 1 | 1 | 0.3 | 0 | 0.1 |
| 5 | 45.6 | 40 | 10 | 2 | 0 | 0 | 0 | 0.4 | 1% (W, Ti)(C, N)<br>1% (W, Zr)C | 0.2 |
| 6 | 68.8 | 20 | 4 | 0 | 3 | 3 | 0 | 0 | 1% $Cr_3C_2$<br>0.2% VC | 0.2 |
| 7 | 58.5 | 30 | 7 | 0 | 2 | 0 | 1 | 0 | 1.5% NbC | 0.5 |
| 8 | 76 | 10 | 10 | 0 | 0 | 2 | 0 | 1 | 1% $Cr_3C_2$ | 1 |
| 9 | 68 | 15 | 15 | 0 | 0 | 0 | 0 | 0 | 1% $Mo_2C$<br>1% $Cr_3C_2$ | — |
| 10 | 36 | 50 | 10 | 2 | 0 | 0 | 0 | 0 | 1% $Cr_3C_2$<br>1% (Ta, Nb)C | — |

In Table 1 above, numerals other than the numerals in the column of Wa/Wb and raw material number represent wt %. Table 1 shows the value Wa/Wb where Wa represents percentage by weight of a carbide, a nitride, or a carbo-nitride of at least one component selected from Va and VIa group elements or a solid solution thereof, and Wb represents percentage by weight of a carbide, a nitride or carbo-nitride of at least one component selected from IVa group elements or a solid solution thereof.

The powders were pressed by a mold with a pressure of 1 ton/cm$^2$, and held for 1 hour at 1550° C. in vacuum for sintering. In this manner, sintered bodies having the shape of ISO standard CNMG 120408 (rhomboid indexable inserts in accordance with JIS B 4120) were fabricated. The sintered bodies were ground by a diamond grinder of #250, and lapped by using diamond paste. Thereafter, using a diamond Vickers indenter with a load of 50 kg, hardness and fracture toughness value $K_{IC}$ (MPam $^{1/2}$) in accordance with Indentation Fracture method, which was found based on a length of crack generated at an indentation corner generated by the indenter, were measured.

For comparison with the present invention, WC powder having average grain diameter of 6 μm, Co powder having average grain diameter of 1.5 μm, Ni powder having average grain diameter of 1.3 μm, ZrC powder having average grain diameter of 2 μm, TiC powder having average grain diameter of 1.5 μm, HfC powder having average grain diameter

TABLE 2

| Sample No. | HV Hardness GPa | Fracture Toughness MPam½ | Presence/Absence of Compound in WC Crystal Grains | Present Invention |
|---|---|---|---|---|
| 1-1 | 15.0 | 9.9 | Present | ○ |
| 2-1 | 14.4 | 7.5 | Absent | |
| 1-2 | 14.6 | 12.3 | Present | ○ |
| 2-2 | 14.0 | 8.5 | Absent | |
| 1-3 | 13.7 | 12.9 | Present | ○ |
| 2-3 | 13.4 | 10.8 | Absent | |
| 1-4 | 12.5 | 16.0 | Present | ○ |
| 2-4 | 11.9 | 14.4 | Absent | |
| 1-5 | 12.5 | 15.2 | Present | ○ |
| 2-5 | 12.3 | 13.3 | Absent | |
| 1-6 | 16.4 | 7.1 | Present | ○ |
| 2-6 | 15.8 | 5.5 | Absent | |
| 1-7 | 15.4 | 8.1 | Present | ○ |
| 2-7 | 14.9 | 6.9 | Absent | |
| 1-8 | 13.5 | 11.7 | Present | ○ |

TABLE 2-continued

| Sample No. | HV Hardness GPa | Fracture Toughness MPam½ | Presence/Absence of Compound in WC Crystal Grains | Present Invention |
|---|---|---|---|---|
| 2-8 | 13.5 | 10.6 | Absent | |
| 1-9 | 12.0 | 15.4 | Present | ○ |
| 2-9 | 11.7 | 14.8 | Absent | |
| 1-10 | 12.6 | 13.2 | Present | ○ |
| 2-10 | 12.5 | 12.5 | Absent | |

In Table 2, the mark ○ represents that the sample is in accordance with the present invention. It can be seen from the results of Table 2 that a compound comprised of a carbide, a nitride or carbo-nitride of at least one component selected from the IVa, Va and VIa group elements or a solid solution thereof exists in WC crystal grains and that hardness and fracture toughness of these samples have higher values as compared with the samples fabricated in accordance with the conventional method.

Figure 2:
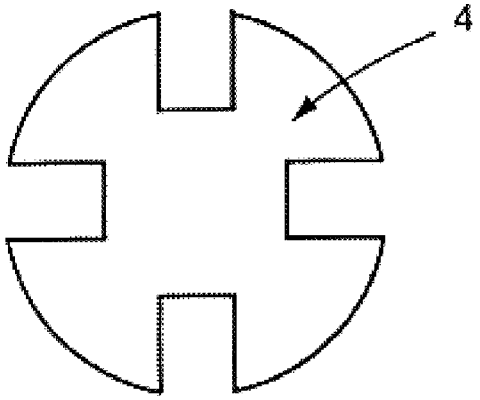
FIG. 2 shows the cross sectional shape of cut material used for a cutting test.

FIG. 1 is a photograph of sample 1-1 viewed by a scanning electron microscope. In FIG. 1, each gray rectangular crystal is a WC crystal grain 1, the black portion corresponds to a Co phase which is a binder phase 2, and each gray particle of precipitation (compound 3) in WC crystal grain is a carbide of Ti. From this photograph, it can be seen that the grain diameter of said compound 3 existing in WC crystal grain 1 of sample 1-1 is about 0.1 $\mu$m, which is not larger than 0.3 $\mu$m. Further, it can be seen that the area of said compound 3 with respect to the area of WC crystal grain 1 containing said compound 3 therein is not more than 10%. In the present invention, presence/absence of the compound in the WC crystal grain was determined using such a cross sectional microstructure.

In the similar manner, it was confirmed that the compound of carbide, nitride or carbo-nitride of Ti, Zr, Hf or W or solid solution thereof exists in the WC crystal grain, in samples 1-2 to 1-8 of Table 2. It is confirmed that a compound of a carbide, a nitride or carbo-nitride of at least one component selected from IVa, Va and VIa group elements or solid solution thereof, other than the carbide, nitride or carbo-nitride of Ti, Zr, Hf or W or solid solution thereof, exists in samples 1-9 and 1-10.

Mechanical properties of samples 1-1 to 1-8 are superior as compared with mechanical properties of samples 2-1 to 2-8 in accordance with the conventional method, and the ratio of improvement is higher than the ratio of improvement of samples 1-9 and 1-10 of the present invention over mechanical properties of samples 2-9 and 2-10 in accordance with the conventional method. More specifically, it is confirmed that as a compound existing in the WC crystal grain, a compound consisting of a carbide, a nitride or carbo-nitride of Ti, Zr, Hf or W or solid solution thereof is preferred and, particularly, sample 1-2 in which carbide and nitride of Zr exist in the WC crystal grain exhibited extremely excellent properties.

Among these, samples 1-1 to 1-6 of which Wa/Wb value is in a range of 0~0.2 where Wa represents percentage by weight of the carbide, nitride, or carbo-nitride of at least one component selected from Va and VIa group elements or solid solution thereof and Wb represents percentage by weight of the carbide, nitride or carbo-nitride of at least one component selected from IVa group elements or solid solution thereof exhibited particularly superior characteristics as compared with samples 2-1 to 2-6 in accordance with the conventional method.

(Embodiment 2)

Raw material numbers 11 to 15 having amounts of TiC, TaC and $Cr_3C_2$ which are carbides of IVa, Va and VIa group elements different in amount from raw material number 8 fabricated in Embodiment 1 were prepared (Table 3), sintered bodies were fabricated in the similar manner as in Embodiment 1, and hardness and fracture toughness were measured. The results are as shown in Table 4. Further, presence/absence of said compound in WC crystal grain was examined in the similar manner as in Embodiment 1, and it was confirmed that said compound existed in the WC crystal grain in all samples.

TABLE 3

| Raw Material No. | Raw Material A | Raw Material B | Co | TiC | TaC | $Cr_3C_2$ | Ratio (%) | Wa/Wb |
|---|---|---|---|---|---|---|---|---|
| 8 | 76 | 10 | 10 | 2 | 1 | 1 | 20 | 1 |
| 11 | 76.9 | 10.1 | 10 | 1.5 | 1 | 0.5 | 15 | 1 |
| 12 | 77.8 | 10.2 | 10 | 1.0 | 0.8 | 0.2 | 10 | 1 |
| 13 | 77.8 | 10.2 | 10 | 1.0 | 0 | 1.0 | 10 | 1 |
| 14 | 79 | 10.4 | 10 | 0.3 | 0.3 | 0 | 3 | 1 |
| 15 | 79 | 10.4 | 10 | 0.3 | 0.2 | 0.1 | 3 | 1 |

The ratio (%) of Table 3 represents ratio (%) of content of the carbide, nitride or carbo-nitride of Va and VIa group elements or solid solution thereof (except WC) with respect to the weight of the binder phase. Numerals other than those in the columns of Wa/Wb, ratio and raw material numbers are in wt %.

TABLE 4

| Sample No. | HV Hardness GPa | Fracture Toughness MPam½ |
|---|---|---|
| 1-8 | 13.5 | 10.6 |
| 1-11 | 13.4 | 11.5 |
| 1-12 | 13.5 | 12.2 |
| 1-13 | 13.3 | 11.8 |
| 1-14 | 13.4 | 14.1 |
| 1-15 | 13.3 | 14.8 |

It was confirmed from the results shown in Table 4 that samples 1-12 to 1-15 in which total amount of added TaC and $Cr_3C_2$ was not more than 10 wt % with respect to the amount of the binder phase had superior mechanical properties and, among these, samples 1-14 and 1-15 where the amount of added TaC and $Cr_3C_2$ was smaller than solid-soluble amount in the binder phase had especially excellent mechanical properties.

(Embodiment 3)

In the similar manner as in Embodiment 1, raw materials 16 to 23 having different mixture ratio of raw materials A and B were prepared with the composition listed in Table 5. These powders were pressed by using a mold with the pressure of 1 ton/cm$^2$, and held for 1 hour at 1500° C. in vacuum for sintering. In this manner, sintered bodies having the shape of ISO CNMG 120408 were fabricated.

TABLE 5

| Raw Material No. | Raw Material A | Raw Material B | Co | ZrC | ZrN | TiC | WA/WB |
|---|---|---|---|---|---|---|---|
| 16 | 0 | 90 | 7 | 1.0 | 1.0 | 1.0 | 0 |
| 17 | 20 | 70 | 7 | 1.0 | 1.0 | 1.0 | 0.29 |
| 18 | 40 | 50 | 7 | 1.0 | 1.0 | 1.0 | 0.8 |
| 19 | 45 | 45 | 7 | 1.0 | 1.0 | 1.0 | 1.0 |
| 20 | 60 | 30 | 7 | 1.0 | 1.0 | 1.0 | 2.0 |
| 21 | 80 | 10 | 7 | 1.0 | 1.0 | 1.0 | 8.0 |

TABLE 5-continued

| Raw Material No. | Raw Material A | Raw Material B | Co | ZrC | ZrN | TiC | WA/WB |
|---|---|---|---|---|---|---|---|
| 22 | 87 | 3 | 7 | 1.0 | 1.0 | 1.0 | 29.0 |
| 23 | 90 | 0 | 7 | 1.0 | 1.0 | 1.0 | — |

In Table 5, numerals other than those in the column of WA/WB and raw material numbers represent wt %.

Hardness and fracture toughness of these samples were measured in the similar manner as in Embodiment 1. The results of measurement are as shown in Table 6. The samples were subjected to surface grinding and mirror polishing, and photographed by a scanning electron microscope of 5000 magnification. By using an image processing apparatus, based on the photographs, WC crystal grains having grain diameter exceeding 1 μm and WC crystal grains having grain diameter not larger than lm were classified, and area ratios of these crystal grains were measured, with the results shown in Table 6. Further, area proportion of WC crystal grains having grain diameter exceeding 1 μm and aspect ratio of at least 2 among these WC crystal grains was measured in the similar manner, with the result also shown in Table 6. Presence/absence of ZrC, ZrN and TiC compound in the WC crystal grains was examined in the similar manner as in Embodiment 1. As a result, it was confirmed that the compound existed in WC crystal grains in samples other than samples 3-16 and 3-23.

TABLE 6

| Sample No. | Area Ratio of WC Crystal Grains Having Grain Diameter of At Most 1 μm (%) | Area Ratio of WC Crystal Grains Having Grain Diameter Exceeding 1 μm (%) | Hv Hardness GPa | Fracture Toughness $MPam^{1/2}$ | Presence/ Absence of Compound in WC Crystal Grains | Ratio of WC Crystal Grains Having Aspect Ratio of at Least 2 among Those Having Grain Diameter Exceeding 1 μm (%) |
|---|---|---|---|---|---|---|
| 3-16 | 2 | 98 | 13.8 | 7.6 | Absent | 5 |
| 3-17 | 5 | 95 | 14.1 | 8.4 | Present | 9 |
| 3-18 | 10 | 90 | 14.5 | 8.9 | Present | 15 |
| 3-19 | 15 | 85 | 14.7 | 9.3 | Present | 25 |
| 3-20 | 25 | 75 | 14.9 | 10.0 | Present | 32 |
| 3-21 | 35 | 65 | 15.0 | 9.8 | Present | 40 |
| 3-22 | 40 | 60 | 14.7 | 8.3 | Present | 52 |
| 3-23 | 50 | 50 | 14.3 | 7.8 | Absent | 67 |

From the results of Table 6, it is understood that in samples 3-18 to 3-21 of which ratio WA/WB of weight WA of raw material A and weight WB of raw material B is in the range of 0.5~30, the area ratio of WC crystal grains having the grain diameter of at most 1 μm was in the range of 10~40%, and had well balanced hardness and fracture toughness. Especially, samples 3-20 and 3-21 where WC crystal grains having the aspect ratio of at least 2 are contained by 30% or more in area ratio with respect to WC crystal grains having the grain diameter exceeding 1 μm, exhibited particularly excellent mechanical properties.

(Embodiment 4)

Tips in the shape of CNMG120408 of samples 1-1 to 1-10 and samples 2-1 to 2-10 fabricated in Embodiment 1 were subjected to honing with 0.05 R, and coating films shown in Table 7 were provided. Cut material 4 of SCM435 having the shape shown in FIG. 2, where four trenches were provided in the circumferential direction in round bar materials, were subjected to a cutting test under the following condition, and time until chipping was measured. The results are as shown in Table 7. In Table 7, DLC in the column of coating film represents diamond-like carbon, CVD represents chemical vapor deposition and PVD represents physical vapor deposition.

Cutting condition

Cutting speed: 100 m/min

Cutting rate: 0.4 mm/rev

Depth of cut: 2 mm

Cutting fluid: dry

TABLE 7

| Sample No. | Coating (Numerical Values in μm) | Method of Coating | Time until Chipping |
|---|---|---|---|
| 1-1 | Base material/TiN 1/TiCN 15/TiC 3/$Al_2O_3$ 2/TiN 1 | CVD | 2'19" |
| 2-1 | Base material/TiN 1/TiCN 15/TiC 3/$Al_2O_3$ 2/TiN 1 | CVD | 21" |
| 1-2 | Base material/TiBN 1/TiCN 5/TiCO 1/$Al_2O_3$ 5 | CVD | 1'15" |
| 2-2 | Base material/TiBN 1/TiCN 5/TiCO 1/$Al_2O_3$ 5 | CVD | 15" |
| 1-3 | Base material/Diamond 3/DLC 1 | CVD | 49" |
| 2-3 | Base material/Diamond 3/DLC 1 | CVD | 8" |
| 1-4 | Base material/TiN 1/TiCN 3 | CVD | 2'47" |
| 2-4 | Base material/TiN 1/TiCN 3 | CVD | 52" |
| 1-5 | Base material/TiN 1/TiCN 2 | PVD | 3'6" |
| 2-5 | Base material/TiN 1/TiCN 2 | PVD | 1'15" |

From the result of measurement of time until chipping shown in Table 7, it can be seen that tools having coatings formed on samples 1-1 to 1-5 in accordance with the present invention exhibits superior characteristics than tools having coatings formed on samples 2-1 to 2-5 in accordance with the conventional method. Similar results could be obtained when diamond in Table 7 was substituted by cubic boron nitride (CBN). Thus it can be understood that samples having coatings on the cemented carbide in accordance with the present invention can exhibit superior characteristics.

(Embodiment 5)

Raw materials Nos. 24 to 28 (Table 8) were fabricated, having the same composition as raw material powder No. 1 fabricated in Embodiment 1, with part of raw material A including recycled WC powder obtained by processing used cemented carbide in accordance with a zinc processing method or a high temperature processing method. These were sintered in the same method as in Embodiment 1, and hardness, fracture toughness and presence/absence of said compound in WC crystal grains were measured in the similar manner as in Embodiment 1. The results are as shown in Table 9.

TABLE 8

| Raw Material No. | Raw Material A wt % | Recycled Powder wt % | Method of Recycle Processing | Raw Material B wt % | Co wt % | TiC wt % | WR/WA |
|---|---|---|---|---|---|---|---|
| 1 | 74 | 0 | — | 20 | 4 | 2 | 0 |
| 24 | 62 | 12 | Zinc Processing Method | 20 | 4 | 2 | 0.16 |
| 25 | 51 | 23 | High Temperature Processing Method | 20 | 4 | 2 | 0.31 |
| 26 | 29 | 45 | Zinc Processing Method | 20 | 4 | 2 | 0.61 |
| 27 | 14 | 60 | High Temperature Processing Method | 20 | 4 | 2 | 0.81 |
| 28 | 0 | 74 | Zinc Processing Method 44% High Temperature Processing Method 30% | 20 | 4 | 2 | 1.0 |

TABLE 9

| Raw Material No. | Hv Hardness GPa | Fracture Toughness MPam½ | Presence/Absence of Compound in WC Crystal Grains |
|---|---|---|---|
| 1 | 15.0 | 9.9 | Present |
| 24 | 15.1 | 10.1 | Present |
| 25 | 15.0 | 9.9 | Present |
| 26 | 15.0 | 9.8 | Present |
| 27 | 15.1 | 9.8 | Present |
| 28 | 14.9 | 10.0 | Present |

From the results shown in Table 9, it can be seen hat alloy characteristics of samples 24 to 28 using powders recycled in accordance with the zinc processing method and high temperature processing method are superior comparable to those of sample 1 not using the recycled powder. In this manner, according to the method of the present invention, it is possible to use recycled powder, which could be used only in a small amount in the conventional method because of its inferior alloy characteristics, as the main component of the WC powder. Therefore, as compared with the conventional method of manufacturing the cemented carbide, cemented carbide can be obtained at a lower cost in an environmentally preferred manner.

(Embodiment 6)

Raw materials Nos. 29 to 32 mixed to the composition of Table 10 were fabricated by using WC powder having average grain diameter of 0.9 μm as raw material A, WC powder having average grain diameter of 4 μm as raw material B, Co powder having average grain diameter of 1.5 μm as raw material C, Cr powder having average grain diameter of 1.8/μm, and ZrCN powders having average grain diameters of 0.1 μm, 0.5 μm and 0.9 μm, as raw material D.

TABLE 10

| Raw Material No. | Raw Material A | Raw Material B | Co | Cr | ZrCN 0.1 μm | ZrCN 0.5 μm | ZrCN 0.9 μm |
|---|---|---|---|---|---|---|---|
| 29 | 70 | 20 | 7 | 0.5 | 0 | 0 | 2.5 |
| 30 | 70 | 20 | 7 | 0.5 | 0 | 1 | 1.5 |
| 31 | 70 | 20 | 7 | 0.5 | 0 | 2.5 | 0 |
| 32 | 70 | 20 | 7 | 0.5 | 2.5 | 0 | 0 |

In Table 10, numerals other than those in the column of Raw material No. are in wt %. Using powders of raw materials 29 to 32, pressing and sintering were performed in the similar manner as in Embodiment 1, and sintered bodies having the shape of ISO CNMG120408 were fabricated. The samples were subjected to cutting test in the similar manner as in Embodiment 4, and time until chipping was measured. The results of measurement are as shown in Table 11. The samples were subjected to surface grinding and mirror polishing, and photographed by a scanning electron microscope with 5000 magnification, and it was confirmed that said compound existed in the WC crystal grains. Further, it was confirmed that the composition of the compound was carbo-nitride of Zr, by EDX analysis. Further, based on this photograph, using an image processing apparatus, the area of crystal grains where existence of said compound was observed within the crystal grains and total area of WC crystal grains in the photograph were measured, and the ratio of area of the WC crystal grains in which said compound existed, among the total crystal grains was calculated. The results are as shown in Table 11.

TABLE 11

| Raw Material No. | Time Until Chipping | Area Ratio (%) of WC Crystal Grains Having the Compound Existing in the Grains |
|---|---|---|
| 29 | 1'36" | 4 |
| 30 | 2'7" | 8 |
| 31 | 3'51" | 13 |
| 32 | 4'29" | 32 |

From the results of Table 11, it can be seen that the area ratio of WC crystal grains incorporating ZrCN therein becomes higher when fine raw material is used as ZrCN powder and that the larger the area ratio of WC crystal grains having said compound existing in the crystal grains, the higher the chipping resistance is improved. Especially, it was confirmed that when the area ratio of WC crystal grains having said compound existing in the crystal grains exceeded 10%, chipping resistance was abruptly increased.

(Embodiment 7)

Using powders having the compositions shown in Table 12, mixing was performed for 2 hours in an acetone solvent, by a ball mill. Thereafter, the powders were dried, pressed by using a mold with a pressure of 1 ton/cm$^2$, and held for 1 hour at a temperature of 1500° C. in vacuum, for sintering. In this manner, sintered bodies Nos. 3-4~3-6 having the shape of CNMG120408 similar to those of Embodiment 1 were fabricated. It was confirmed by EDX or X-ray qualitative analysis using a transmission electron microscope that compounds shown in Table 13 existed in WC crystal grains of these sintered bodies. Hardness and fracture toughness of the samples were measured in the similar manner as Embodiment 1. The results are as shown in Table 14.

TABLE 12

| Raw Material No. | Average Grain Diameter 0.8 μm WC | Average Grain Diameter 3 μm WC | Average Grain Diameter 1.5 μm Co | Average Grain Diameter 0.3 μm Ti Compound | Average Grain Diameter 2 μm Ti Compound | Average Grain Diameter 0.3 μm Zr Compound | Average Grain Diameter 2 μm Zr Compound |
|---|---|---|---|---|---|---|---|
| 33 | 60 | 20 | 10 | TiC5 | — | — | ZrC5 |
| 34 | 60 | 20 | 10 | TiCN5 | — | — | ZrCN5 |
| 35 | 60 | 20 | 10 | TiN5 | — | — | ZrN5 |
| 36 | 60 | 20 | 10 | — | TiC5 | ZrC5 | — |
| 37 | 60 | 20 | 10 | — | TiCN5 | ZrCN5 | — |
| 38 | 60 | 20 | 10 | — | TiN5 | ZrN5 | — |

Numerals represent wt %

TABLE 13

| Sample No. | Raw Material No. | Compound Existing in WC Grains | Area Proportion (%) of Compound with Respect to Area of WC Crystal Grains Having Compounds Therein (%) | Present Invention |
|---|---|---|---|---|
| 3-1 | 33 | TiC | 5 | ○ |
| 3-2 | 34 | TiCN | 5 | ○ |
| 3-3 | 35 | TiN | 5 | ○ |
| 3-4 | 36 | ZrN | 5 | ○ |
| 3-5 | 37 | ZrCN | 5 | ○ |
| 3-6 | 38 | ZrN | 5 | ○ |

TABLE 14

| Sample No. | HV Hardness GPa | Fracture Toughness MPam½ | Time Until Chipping | Present Invention |
|---|---|---|---|---|
| 3-1 | 15.8 | 7.9 | 3'52" | ○ |
| 3-2 | 15.7 | 8.1 | 4'15" | ○ |
| 3-3 | 15.5 | 7.6 | 4'38" | ○ |
| 3-4 | 15.6 | 10.5 | 6'12" | ○ |
| 3-5 | 15.5 | 10.4 | 5'56" | ○ |
| 3-6 | 15.4 | 10.3 | 6'24" | ○ |

From the results shown in Table 14, it was confirmed that samples 3-4 to 3-6 in which Zr compound was precipitated in WC crystal grains had better balanced hardness and fracture toughness than samples 3-1~3-3 in which Ti compound was precipitated in WC crystal grains. Further, the sintered bodies were subjected to surface grinding, peripheral grinding and honing with 0.05 R, and coated with coatings including layers of 0.5/μm of TiN, 5 μm of TiCN, 3 μm of TiC, 2gm of alumina and 0.5 μm of TiN starting from the lower layer, by CVD method. Using these samples, the cut material used in Embodiment 4 was cut under the following condition, and time until chipping was measured. The results are as shown in Table 14.

Cutting condition

Cutting speed: 200 m/min

Cutting rate: 0.2 mm/rev

Depth of cut: 2 mm

Cutting fluid: wet

From the results shown in Table 14, it was confirmed that samples 3-4~3-6 in which Zr compound was precipitated in WC crystal grains exhibited superior chipping resistance in comparison to samples 3-1~3-3 in which Ti compound was precipitated in WC crystal grains.

As described above, according to the present invention, as a compound of a carbide, a nitride or carbo-nitride of at least one component selected from IVa, Va and VIa group elements or a solid solution thereof is generated in WC crystal grains, WC crystals having superior strength are obtained, which is particularly effective when the WC crystal grains have a plate-like shape. As a result, a cemented carbide having superior strength and toughness can be provided.

The present invention is advantageously applicable to tools such as cutting tools and shock resistant tools.

What is claimed is:

1. A cemented carbide comprising a binder phase and crystal grains dispersed in said binder phase, wherein:

said binder phase comprises an iron group metal as a greatest portion of said binder phase;

said crystal grains comprise tungsten carbide as a greatest portion of said crystal grains;

said crystal grains include first crystal grains that further comprise compound grains therein, and said compound grains have an average grain diameter of less than 0.3 μm;

said compound grains comprise a carbide, a nitride or a carbo-nitride of at least one element selected from the group consisting of periodic group IVa elements, periodic group Va elements and periodic group VIa elements, and solid solutions thereof, other than tungsten carbide;

a compound grain cross-sectional area covered by said compound grains is at most 10% of a first crystal grain cross-sectional area covered by said first crystal grains on a cross-section of said cemented carbide; and said first crystal grain cross-sectional area is at least 10% of a total crystal grain cross-sectional area covered by all of said crystal grains on said cross-section.

2. The cemented carbide according to claim 1, wherein said compound grains consist essentially of said carbide, said nitride, or said carbo-nitride, and wherein said at least one element is selected from the group consisting of titanium, zirconium, hafnium, and tungsten.

3. The cemented carbide according to claim 2, wherein a total content of said titanium, said zirconium and said hafnium is at most 5 wt. % with respect to a total weight of said cemented carbide.

4. The cemented carbide according to claim 1, wherein said at least one element comprises zirconium.

5. The cemented carbide according to claim 1, wherein said compound grains incorporated in said first crystal grains have a sectional shape having an aspect ratio of at least 2 on said cross-section of said cemented carbide.

6. The cemented carbide according to claim 1, wherein said compound contains a first weight percentage (Wa) of said carbide, said nitride or said carbo-nitride of said at least one element which is selected from the group consisting of said periodic group Va elements and said periodic group VIa elements, and solid solutions thereof, other than tungsten carbide;

wherein said compound further contains a second weight percentage (Wb) of said carbide, said nitride or said carbo-nitride of said at least one element which is selected from the group consisting of periodic group IVa elements, tungsten, and solid solutions thereof, other than tungsten carbide; and wherein a ratio (Wa/Wb) of said first weight percentage (Wa) relative to said second weight percentage (Wb) is in a range from 0 to 0.2.

7. The cemented carbide according to claim 1, wherein said compound contains a first weight content of said carbide, said nitride, or said carbo-nitride of said at least one element which is selected from the group consisting of said periodic group Va elements and said periodic group VIa elements, and solid solutions thereof, other than tungsten carbide, and wherein said first weight content is at most 10 wt. % relative to a binder weight content of said binder phase in said cemented carbide.

8. The cemented carbide according to claim 1, wherein said crystal grains include smaller ones of said crystal grains having a grain diameter of at most 1 $\mu$m, and larger ones of said crystal grains having a grain diameter greater than 1 $\mu$m;

wherein said smaller crystal grains cover a smaller grain cross-sectional area that is from 10% to 40% of said total crystal grain cross-sectional area on said cross-section of said cemented carbide; and wherein said larger crystal grains cover a larger crystal grain cross-sectional area that is from 60% to 90% of said total crystal grain cross-sectional area on said cross-section of said cemented carbide.

9. The cemented carbide according to claim 8, wherein at least 30% of said larger crystal grains have a cross-sectional shape having an aspect ratio of at least 2 on said cross-section of said cemented carbide.

10. The cemented carbide according to claim 1, wherein said first crystal grain cross-sectional area is greater than 30% of said total crystal grain cross-sectional area.

11. A tool comprising a combination of a tool substrate consisting essentially of said cemented carbide according to claim 1, and a coating layer provided on a surface of said tool substrate, wherein said coating layer consists essentially of a carbide, a nitride, an oxide, or a boride of at least one element selected from the group consisting of the periodic group IVa elements, the periodic group Va elements, the periodic group VIa elements, aluminum, and solid solutions thereof, or of at least one composition selected from the group consisting of diamond, diamond-like-carbon (DLC) and cubic boron nitride (CBN).

12. A method of manufacturing a cemented carbide, comprising the following steps:

providing a first weight amount (WA) of a first tungsten carbide powder having a first powder average grain diameter of 0.6 $\mu$m to 1 $\mu$m;

providing a second weight amount (WB) of a second tungsten carbide powder having a second powder average grain diameter of at least twice said first powder average grain diameter, wherein a ratio (WA/WB) of said first weight amount (WA) relative to said second weight amount (WB) is from 0.5 to 30;

providing a metal powder of at least one metal selected from the group consisting of cobalt, nickel, chromium, iron, and molybdenum;

providing a compound powder comprising a carbide, a nitride, or a carbo-nitride of at least one element selected from the group consisting of the periodic group IVa elements, the periodic group Va elements, and the periodic group VIa elements, and solid solutions thereof, other than tungsten carbide, wherein said compound powder has a compound powder average grain diameter of 0.01 $\mu$m to 0.5 $\mu$m;

mixing together said first tungsten carbide powder, said second tungsten carbide powder, said metal powder and said compound powder to prepare a mixed powder; and sintering said mixed powder.

13. The method according to claim 12, wherein said step of providing said first tungsten carbide powder comprises providing a recycled powder of a prior cemented carbide as at least a portion of said first tungsten carbide powder.

14. The method according to claim 13, wherein said step of providing said first tungsten carbide powder further comprises milling said recycled powder, and providing a weight content (WR) of said recycled powder that amounts to 30 wt. % to 100 wt. % of said first weight amount (WA) of said first tungsten carbide powder.

15. The method according to claim 12, wherein said steps of providing said first and second tungsten carbide powders are carried out so that said ratio (WA/WB) of said first weight amount (WA) relative to said second weight amount (WB) is from 1 to 10.

16. The method according to claim 12, wherein said sintering is carried out at a sintering temperature of at least 1500° C.

17. The method according to claim 12, wherein said sintering is carried out so as to melt said first tungsten carbide powder to the liquid phase, and then to re-precipitate tungsten carbide from said liquid phase to grow tungsten carbide crystal grains on said second tungsten carbide powder.

18. The method according to claim 17, wherein grains of said second tungsten carbide powder act as seed crystals for said re-precipitating.

* * * * *

UNITED STATES PATENT AND TRADEMARK OFFICE

CERTIFICATE OF CORRECTION

PATENT NO. : 6,299,658 B1
DATED : October 9, 2001
INVENTOR(S) : Moriguchi et al.

It is certified that error appears in the above-identified patent and that said Letters Patent is hereby corrected as shown below:

Column 1,
Line 30, after "of", replace "110-10" by -- 1-10 μm --;

Column 2,
Line 67, after "than", replace "lam" by --1 μm --;

Column 3,
Line 41, after "most", replace "lam" by -- 1μm --;

Column 5,
Line 7, after "Bridgman", delete "—";

Column 6,
Line 11, after "of", replace "0.6—1 μm" by -- 0.6 ~ 1 μm --;

Column 11,
Line 20, after "than", replace "1m" by -- 1 μm --;

Column 13,
Line 29, after "seen", replace "hat" by -- that --;
Line 48, after "of", replace "1.8/μm," by -- 1.8 μm, --;

Column 15,
Line 49, after "of" (1st occurrence), replace "0.5/μm" by -- 0.5 μm --;
Line 50, after "TiC,", replace "2gm" by -- 2μm --.

Signed and Sealed this

Eighteenth Day of June, 2002

*Attest:*

*Attesting Officer*

JAMES E. ROGAN
*Director of the United States Patent and Trademark Office*